US006130691A

United States Patent [19]

Takemoto et al.

[11] Patent Number: 6,130,691

[45] Date of Patent: Oct. 10, 2000

[54] INKJET RECORDING APPARATUS HAVING SPECIFIC DRIVING CIRCUITRY FOR DRIVING ELECTROPHORESIS ELECTRODES

[75] Inventors: Hitoshi Takemoto; Tadashi Mizoguchi; Junichi Suetsugu; Hitoshi Minemoto; Kazuo Shima; Yoshihiro Hagiwara; Toru Yakushiji, all of Niigata, Japan

[73] Assignee: NEC Corporation, Tokyo, Japan

[21] Appl. No.: 08/975,548

[22] Filed: Nov. 20, 1997

[30] Foreign Application Priority Data

Nov. 21, 1996 [JP] Japan ..... 8-310441
Dec. 2, 1996 [JP] Japan ..... 8-321891

[51] Int. Cl.[7] ..... B41J 2/06

[52] U.S. Cl. ..... 347/55

[58] Field of Search ..... 347/55, 141, 142, 347/50, 48

[56] References Cited

U.S. PATENT DOCUMENTS

| | | | |
|---|---|---|---|
| 4,293,865 | 10/1981 | Jinnai et al. | 347/48 |
| 4,975,718 | 12/1990 | Akami et al. | 347/55 |
| 5,600,355 | 2/1997 | Wada | 347/55 |
| 5,742,412 | 4/1998 | Minemoto et al. | 347/20 |
| 5,754,200 | 5/1998 | Minemoto et al. | 347/55 |
| 5,801,730 | 9/1998 | Shima et al. | 347/55 |
| 5,818,473 | 10/1998 | Fujii et al. . | |
| 5,874,972 | 2/1999 | Suetsugu et al. | 347/55 |
| 5,877,790 | 3/1999 | Hagiwara et al. . | |
| 5,997,133 | 12/1999 | Takemoto et al. | 347/55 |

FOREIGN PATENT DOCUMENTS 93 11866 6/1993 WIPO .

*Primary Examiner*—Robert Beatty
*Attorney, Agent, or Firm*—Ostrolenk, Faber, Gerb & Soffen, LLP

[57] ABSTRACT

An inkjet recording apparatus includes K ejection electrodes, M electrophoresis electrodes corresponding to M blocks into which the K ejection electrodes are divided, respectively, and an electrode opposite to the K ejection electrodes. A first voltage pulse is applied to a selected one of N groups each formed by electrically connecting an $i^{th}$ ($1 \leqq i \leqq N$) ejection electrode for each block to each other. A second voltage pulse is applied to a selected one of the M electrophoresis electrodes. Ink ejection occurs at a desired ejection electrode specified by the selected group and the selected electrophoresis electrode in the case of a predetermined voltage applied to the electrode opposite to the K ejection electrodes.

32 Claims, 6 Drawing Sheets

INKJET RECORDING APPARATUS HAVING SPECIFIC DRIVING CIRCUITRY FOR DRIVING ELECTROPHORESIS ELECTRODES

BACKGROUND OF THE INVENTION

1. Field of the Invention

The present invention relates to an inkjet recording apparatus which is capable of ejecting particulate matter such as pigment matter and toner matter by making use of an electric field, and more particularly to control for the inkjet recording apparatus.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. As one of the inkjet recording methods, there is an electrostatic inkjet recording method.

The electrostatic inkjet recording apparatus generally has an electrostatic inkjet recording head and a counter electrode which is disposed behind the recording medium to form an electric field between it and the recording head. The electrostatic inkjet recording head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed. A recording head such as this is disclosed, for example, in PCT International Publication No. WO93/11866.

According to the conventional inkjet recording head, however, the respective ejection electrodes are independently driven by drivers supplying driving voltages depending on input data (see FIG. 4 and page 9, lines 21–31, of the above publication No. WO93/11866). Especially, in the case of a multi-head having an array of dozens of heads or a line head having a linear array of hundreds to thousands of ejection electrodes, it is necessary to provide driver circuits as many as the ejection electrodes, resulting in complicated circuit configuration and the increased amount of hardware. This causes the size and cost of the recording apparatus to be increased.

Further, variations in the positions and shapes of the ejection electrodes inevitably occur in practical manufacturing processes. In such cases, an amount of pigment matter (or toner matter) ejected from an ejection electrode is different from that of another ejection electrode even when the same driving voltage is applied to them, resulting in deteriorated quality of an image formed on a recording medium. More specifically, in the case where an ejection electrode has a more acute tip angle, the electric field is more likely to be concentrated thereon. Therefore, the increased amount of pigment matter is ejected from that ejection electrode, resulting in a larger ink dot formed on a recording paper. Similarly, in the case of variations in distance between an ejection electrode and the counter electrode, the smaller the distance, the larger the ink dot. Furthermore, the electric field is more likely to be concentrated on the ejection electrodes located at both ends, which causes the ink dots at both ends to increase in size. Such variations in ink dot size become more pronounced with the number of ejection electrodes.

SUMMARY OF THE INVENTION

An objective of the present invention is to provide an inkjet apparatus which can selectively eject ink from a plurality of ejection electrodes with precision and with the reduced amount of hardware.

Another objective of the present invention is to provide an apparatus which can reduce the number of ejection electrode drivers.

Further another objective of the present invention is to provide an inkjet recording apparatus and a control method therefor which can achieve the high quality of an image.

Still another objective of the present invention is to provide an inkjet recording apparatus and a control method therefor which can eject a uniform amount of ink from each of a plurality of ejection electrodes.

According to the present invention, the apparatus is provided with a first number K (K is an integer) of first electrodes each for ejecting an aggregation of particulate matter in a predetermined direction and an second electrode located at a distance from the ejection electrodes in the predetermined direction. Further, a second number M (M is an integer smaller than K) of electrophoresis electrodes are located at a distance from the ejection electrodes in an opposite direction to the predetermined direction. A selected one of N groups into which the K ejection electrodes are divided and a selected one of the M electrophoresis electrodes are driven such that ejection of a desired first electrode is caused in a state that a predetermined voltage is applied to the second electrode.

According to the present invention, an apparatus may include a first number K (K is an integer) of first electrodes each for ejecting an aggregation of particulate matter in a predetermined direction, the K first electrodes being divided into M (M is an integer) blocks each having N first electrodes, where N is K/M, an second electrode located at a distance from the ejection electrodes in the predetermined direction, and M electrophoresis electrodes located at a distance from the K first electrodes in an opposite direction to the predetermined direction, each of the M electrophoresis electrodes corresponding to the M blocks of the first electrodes. A first voltage pulse is produced to be applied to a selected one of N groups into which the K first electrodes are divided in a different way from the M blocks and a second voltage pulse is produced to be applied to a selected one of the M electrophoresis electrodes. A selected group and a selected electrophoresis electrode are driven depending on an input signal to cause ejection of a first electrode specified by the selected group and the selected electrophoresis electrode.

The apparatus may be provided with an adjuster which adjusts the second voltage pulse depending on which one is selected from the M electrophoresis electrode so as to provide a substantially uniform amount of ejected particulate matter and applying an adjusted second voltage pulse to the selected one of the M electrophoresis electrode. The adjuster may adjust one of a pulse width and a pulse voltage of the second voltage pulse.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

Figure 1A:
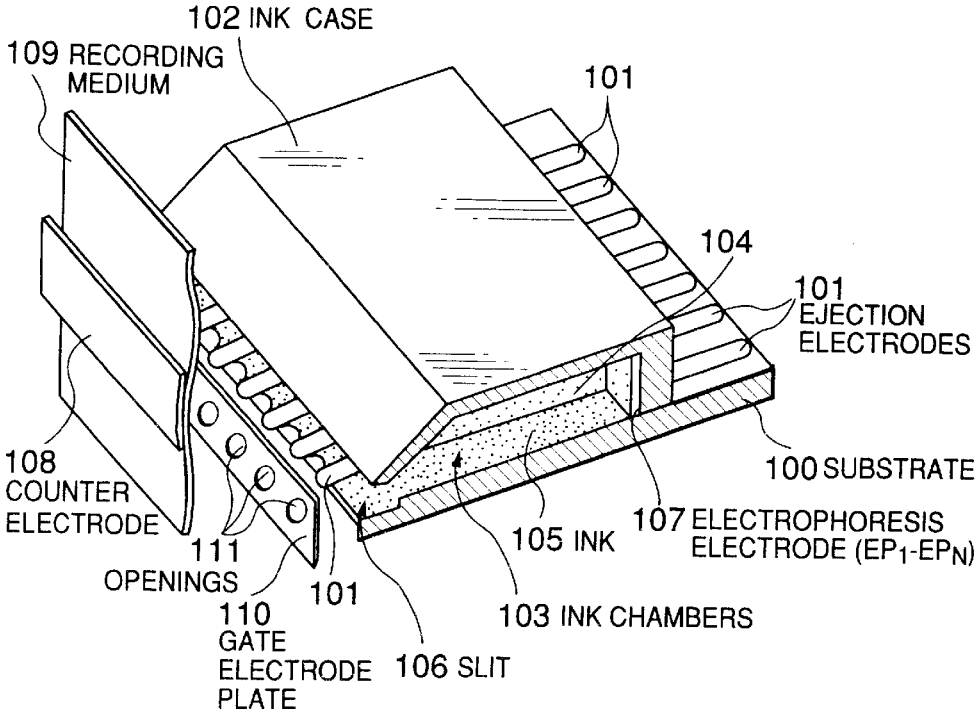
FIG. 1A is a part-fragmentary perspective view showing an inkjet head of an inkjet recording apparatus according to the present invention.
Figure 1B:
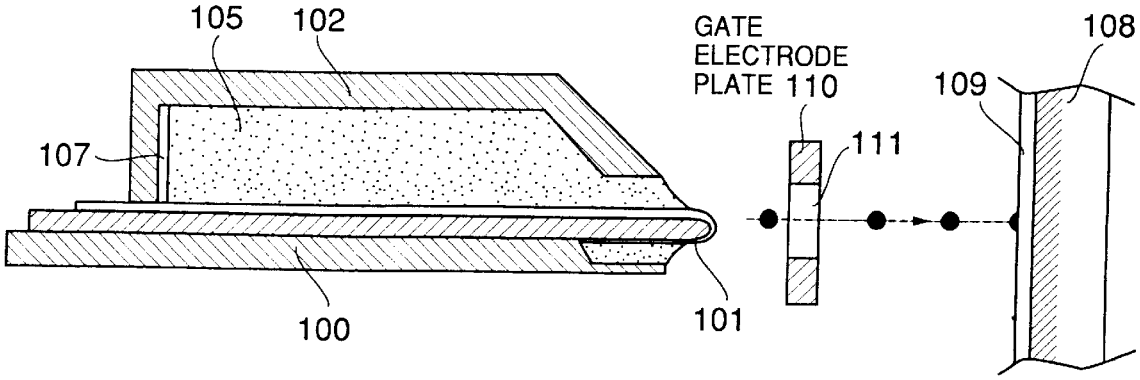
FIG. 1B is a cross sectional view showing the inkjet head as shown in FIG. 1A.

Referring to FIGS. 1A and 1B, there is shown an inkjet recording head to which the present invention can be applied. A substrate 100 is made of an insulator such as plastic and has a plurality of needle-like ejection electrodes 101 formed thereon in accordance with a predetermined pattern. The portions of the ejection electrodes 101 in the ink chamber are covered with an insulating film. An ink case 102 made of an insulating material is mounted on the substrate 100. The space, defined by the substrate 100 and the ink case 102, constitutes an ink chamber 103 which is partitioned into N sub-chambers by internal walls 104. The ink chamber 103 is filled with ink 105 containing toner particles which is supplied through an ink supply port (not shown) and is discharged through an ink discharge port (not shown). The front end of the ink case 102 is cut out to form a slit 106 between the ink case 102 and the substrate 100. The ejection ends of the ejection electrodes 101 are disposed in the slit 106. The ejection electrodes 101 are directed to a counter electrode 108 on which a recording medium 109 is placed.

At the internal rear end of the ink case 102, N electrophoresis electrodes 107 indicated by $EP_1$–$EP_N$ are provided within the sub-chambers, respectively. As described later, a predetermined voltage $V_D$ is selectively applied to the electrophoresis electrodes 107.

Further, a gate electrode plate 110 which is provided with a plurality of openings 111 having a gate electrode is placed at a predetermined position between the ejection end of each ejection electrodes 101 and the counter electrode 108 such that the openings 111 correspond to the ejection electrodes 101, respectively. In other words, a small group of ink particles is jetted from a selected ejection electrode to the recording medium 109 through the corresponding opening of the gate electrode plate 110 as shown in FIG. 1B. Each opening 111 may be shaped like a circle or a slit.

A gate driving voltage $V_G$ is applied to the gate electrodes of the gate electrode plate 110 and a voltage $V_{EE}$ which is higher than $V_G$ is applied to a selected ejection electrode. A voltage Vc which is lower than $V_G$ is applied to the counter electrode 108. Therefore, if a voltage $V_D$ ($>V_G$) with the same polarity as toner particles is applied to a selected one of the electrophoresis electrodes 107, then an electric field will be generated in the corresponding sub-chamber provided with the selected electrophoresis electrode. This causes toner particles to be moved toward the front ends of the ejection electrodes in the sub-chamber corresponding to the selected electrophoresis electrode due to the electrophoresis phenomenon and thereby meniscuses are formed at the front ends of the ejection electrodes. Therefore, when an ejection voltage pulse of $V_{EE}$ is applied to the selected ejection electrode to generate a voltage difference more than a threshold between the selected ejection electrode and the corresponding gate electrode, the particulate matter concentrated on the tip of that ejection electrode is jetted to the recording medium 109 though the corresponding opening of the gate electrode plate 110.

FIRST EMBODIMENT

Figure 2:
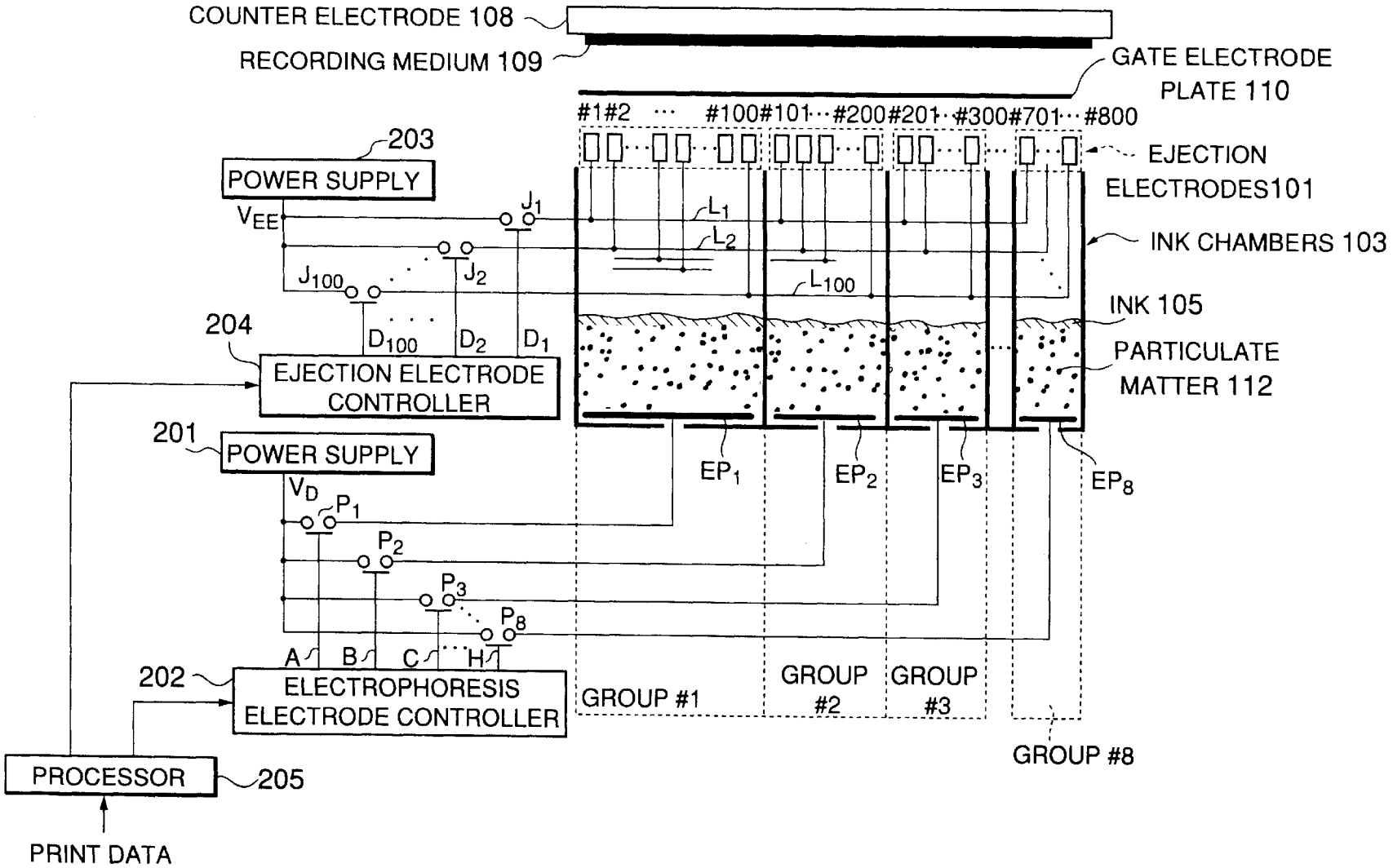
FIG. 2 is a block diagram showing a circuit configuration of the inkjet recording apparatus according to a first embodiment of the present invention.

FIG. 2 shows a circuit of a first embodiment according to the present invention, where elements of the inkjet device similar to those previously described with reference to FIGS. 1A and 1B are denoted by the same reference numerals. In the first embodiment, the gate driving voltage $V_G$ is applied to the gate electrode plate 110. In other words, all the gate electrodes are set to the gate driving voltage $V_G$.

The electrophoresis electrodes $EP_1$–$EP_8$ corresponding to groups #1–#8 are provided at the rear internal wall of the sub-chambers, respectively. The electrophoresis electrodes $EP_1$–$EP_8$ are connected to a power source 201 through electrophoresis electrode driver switches $P_1$–$P_8$, respectively. The respective driver switches $P_1$–$P_8$ receive control signals A–H from an electrophoresis electrode controller 202 to switch on and off, respectively. The power source 201 generates the electrophoresis electrode driving voltage $V_D$ which is supplied to the driver switches $P_1$–$P_8$. Therefore, depending on the control signals A–H, the driving voltage $V_D$ is selectively applied to the electrophoresis electrodes $EP_1$–$EP_8$.

The ejection electrodes 101 number eight hundreds, #1–#800, where eight groups of a hundred ejection electrodes correspond to the groups #1–#8, respectively. For example, the first eight ejection electrodes #1–#100 form a first group corresponding to the group #1, the second eight ejection electrodes #101–#200 form a second group corresponding to the group #2, and so on.

Further, the ejection electrodes 101 are electrically divided into a hundred ejection electrode groups such that the one-hundred ejection electrodes for each group #1, #2, . . . , or #8 are connected to driving lines $L_1$–$L_{100}$, respectively. More specifically, the first ejection electrode for each group is connected in common to a driving line $L_1$. That is, the ejection electrodes #1, #101, #201, . . . #701 are connected in common to the driving line $L_1$. The second ejection electrode for each gate group is connected in common to a driving line $L_2$. That is, the ejection electrodes #2, #102, #202, . . . #702 are connected in common to the driving line $L_2$. It is the same with the third to the hundredth ejection electrodes for each group.

The driving lines $L_1$–$L_{100}$ are connected to a power source 203 through driver switches $J_1$–$J_{100}$, respectively. The respective driver switches $J_1$–$J_{100}$ receive electrode control signals $D_1$–$D_{100}$ from an ejection electrode controller 204. The driver switches $J_1$–$J_{100}$ switch on and off depending on the ejection electrode control signals $D_1$–$D_{100}$, respectively. The power source 203 generates the driving voltage $V_{EE}$ which is supplied to the driver switches $J_1$–$J_{100}$. Therefore, depending on the ejection electrode control signals $D_1$–$D_{100}$, the driving voltage $V_{EE}$ is selectively applied to the driving lines $L_1$–$L_{100}$.

Ink ejection from an ejection electrode requires that a voltage difference between the ejection electrode and the corresponding gate electrode is equal to or greater than a predetermined threshold value $V_{th}$ in the case of the electrophoresis voltage $V_D$ applied to the corresponding electrophoresis electrode. More specifically, in the case where the electrophoresis voltage $V_D$ ($>V_G$) is applied to the electrophoresis electrode $EP_1$, the electric field generated in the sub-chamber of the group #1 causes particulate matter 112 such as toner to be moved toward the front ends of the ejection electrodes #1–#100 in the sub-chamber to form meniscuses at the front ends thereof. In this state, when the ejection voltage $V_{EE}$ is applied to a selected ejection electrode (for example, the first ejection electrode #1) for the group #1, the particulate matter concentrated on the tip of the ejection electrode #1 is jetted to the recording medium 109 though the corresponding opening of the gate electrode plate 110. When the electrophoresis voltage $V_D$ is not applied to the electrophoresis electrode $EP_1$, the ink ejection from the ejection electrode #1 cannot occur. Therefore, by controlling the timing of applying the ejection voltage $V_{EE}$ and the electrophoresis voltage $V_D$, the particulate matter can be ejected from a selected ejection electrode.

The electrophoresis electrode controller 202 and the ejection electrode controller 204 are controlled by a processor 205 performing image formation control according to input print data. The details of the control will be described hereinafter.

Figure 3:
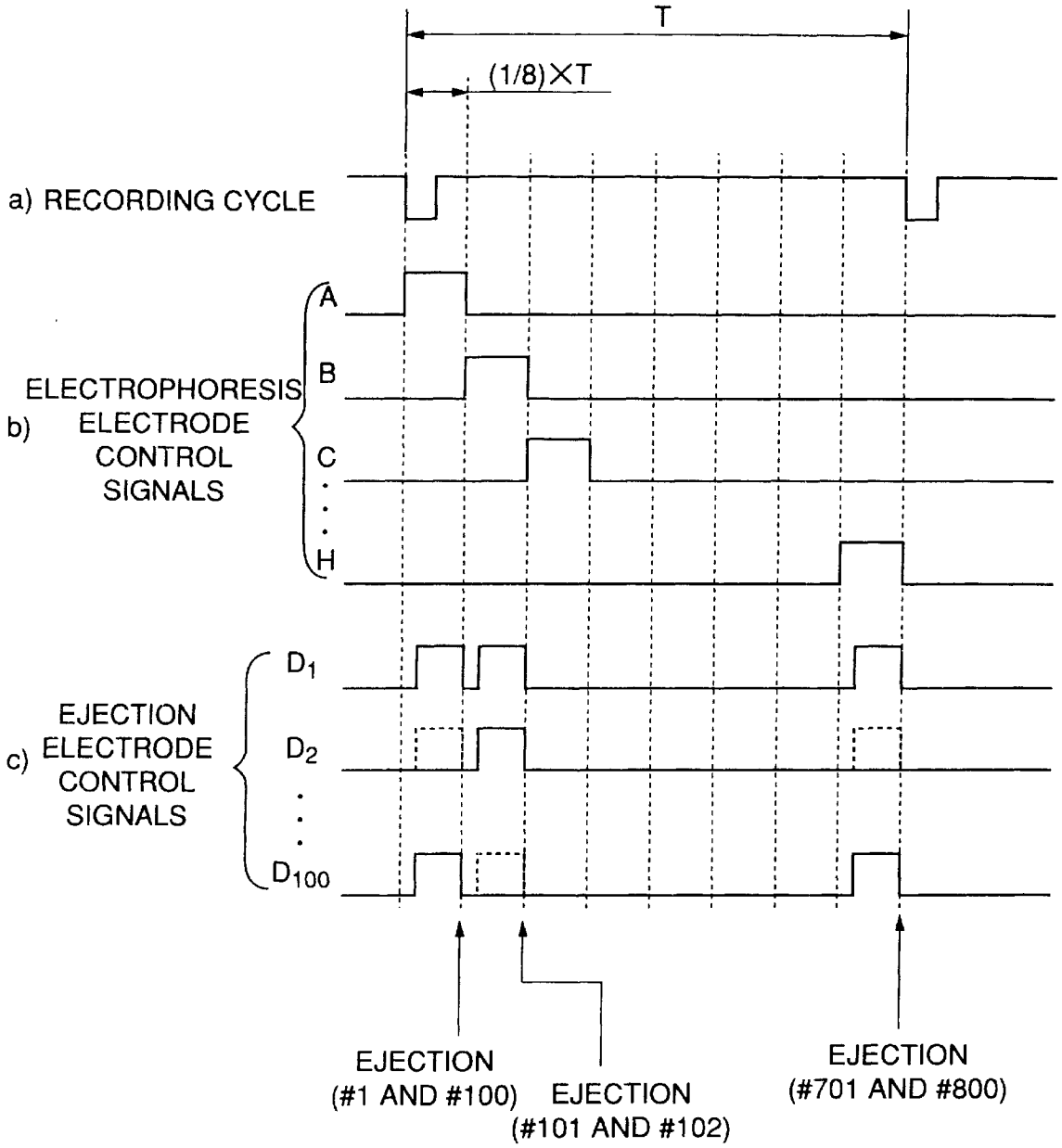
FIG. 3 is a time chart showing control signals for ejection electrodes and electrophoresis electrodes of the inkjet recording apparatus according to the first embodiment.

Referring to FIG. 3, the electrophoresis electrode controller 202 sequentially outputs the electrophoresis electrode control signals A–H to the driver switches $P_1$–$P_8$, respectively, during a recording period T. The pulse width of each electrophoresis electrode control signal is set to a time slot obtained by dividing the recording period T by the number of the electrophoresis electrode control signals A–H. In other words, the recording period T is time-divided into eight time slots each having a time period of T/8. In parallel with the electrophoresis ejection electrode controller 202, the ejection electrode controller 204 selectively outputs the ejection electrode control signals $D_1$–$D_{100}$ to the driver switches $J_1$–$J_{100}$, respectively, under the control of the processor 205. In this embodiment, the pulse width of each ejection electrode control signal is set to less than the time slot of T/8 and the leading edge thereof is preferably delayed from that of the corresponding time slot.

More specifically, when receiving a recording timing pulse from the processor 205, the electrophoresis electrode controller 202 generates the electrophoresis electrode control signals A–H in sequence as shown in b) of FIG. 3. For example, when the electrophoresis electrode control signal A rises on the falling edge of the recording timing pulse, the driver switch $P_1$ is closed to apply the voltage $V_D$ to the electrophoresis electrodes $EP_1$. When the electrophoresis electrode control signal B rises after the electrophoresis electrode control signal A has fallen, the voltage $V_D$ is applied to the electrophoresis electrode $EP_2$. It is the same with other electrophoresis electrode control signals C–H.

When the ejection control signals $D_1$ and $D_{100}$ rise on the falling edge of the recording timing pulse, the driver switches $J_1$ and $J_{100}$ are closed to apply the driving voltage $V_{EE}$ to the first ejection electrode group of the ejection electrodes #1, #101, #201, . . . , and #701 and the $100^{th}$ electrode group of the ejection electrodes #100, #200, . . . , and #800. Since the electrophoresis voltage $V_D$ is applied only to the first electrophoresis electrode $EP_1$ during the first time slot, the ink is ejected only from the ejection electrodes #1 and #100 on the falling edge of the electrode control signals $D_1$ and $D_{100}$.

Subsequently, when the electrophoresis electrode control signal B rises in the second time slot, the driver switch $P_2$ is closed to apply the voltage $V_D$ to the electrophoresis electrode $EP_2$. In the same time slot, when the control signals $D_1$ and $D_2$ rise, the driver switches $J_1$ and $J_2$ are closed to apply the driving voltage $V_{EE}$ to the first ejection electrode group of the ejection electrodes #1, #101, #201, . . . , and #701 and the second electrode group of the ejection electrodes #2, #102, . . . , and #702. Since the electrophoresis voltage $V_D$ is applied only to the second electrophoresis electrode $EP_2$ during the second time slot, the ink is ejected only from the ejection electrodes #101 and #102 on the falling edge of the electrode control signals $D_1$ and $D_2$. Similarly, when the electrophoresis electrode control signal H and the ejection control signal $D_1$ and $D_{100}$ rise in the last time slot, only the ejection electrodes #701 and #800 eject the ink.

As described above, only a total of one hundred and eight driver circuits including a hundred driver switches $J_1$–$J_{100}$ and eight driver switches $P_1$–$P_8$ can drive the eight hundred ejection electrodes #1–#800.

The present invention is not limited to the combination of the 100 driver switches $J_1$–$J_{100}$ and the 8 driver switches $P_1$–$P_8$ as shown in FIG. 2. Another combination may be possible. For example, in the case of a combination of 50 driver switches $J_1$–$J_{50}$ and 16 driver switches $P_1$–$P_{16}$, only a total of sixty-six driver circuits can also drive the eight hundreds ejection electrodes #1–#800. In the case of a combination of 25 driver switches $J_1$–$J_{25}$ and 32 driver switches $P_1$–$P_{32}$, the minimized number of driver circuits may be obtained. In summary, if the number of ejection electrodes to be driven is K, the number of driver switches for electrophoresis electrodes is M, and the number of driver switches for ejection electrodes is N, then the total number (M+N) is minimized when both M and N equal to the square root of K. Since both M and N are integral numbers, a pair of integral numbers M and N which are closest to the square root of K is a solution.

SECOND EMBODIMENT

Figure 4:
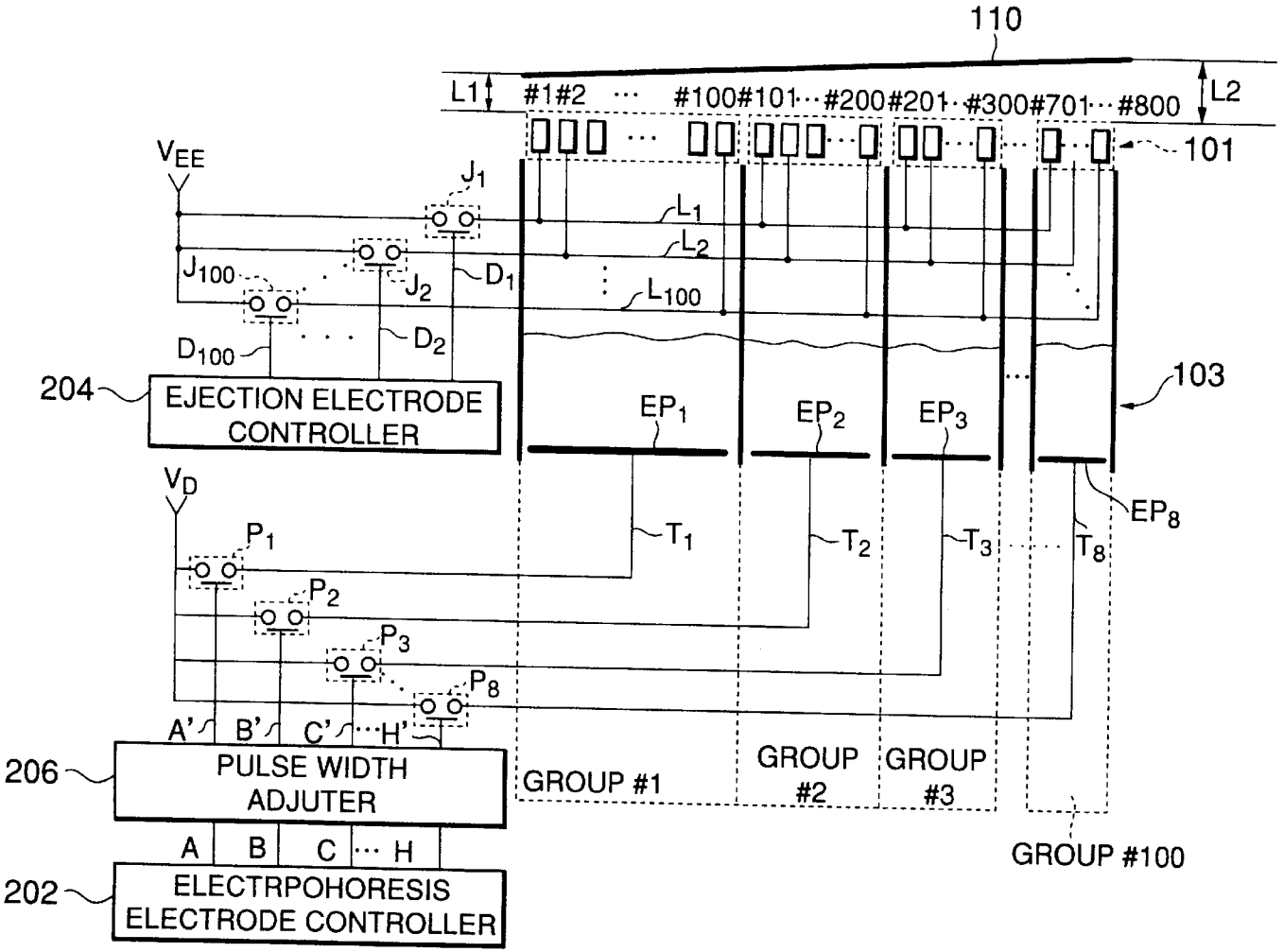
FIG. 4 is a block diagram showing a circuit configuration of the inkjet recording apparatus according to a second embodiment of the present invention.

FIG. 4 shows a circuit of a second embodiment according to the present invention, where elements of the inkjet device similar to those previously described with reference to FIG. 2 are denoted by the same reference numerals. It is assumed that the gate electrode plate 110 is not parallel with the array of the ejection electrodes 101 due to variations in the position and shape of the gate electrode plate 110 or the array of the ejection electrodes 101. Here, for simplicity, the distance between each ejection electrode and the corresponding gate electrode are changed with the number of ejection electrode. For example, the distance L1 at one end between the first ejection electrode #1 and the corresponding gate electrode is shorter than the distance L2 at the other end between the last ejection electrode #800 and the corresponding gate electrode. Such variations cause variations in amount of ejected ink. In the second embodiment, variations in amount of ejected ink can be eliminated by adjusting the pulse width of an electrophoresis electrode control signal as will be described later.

As shown in FIG. 4, the electrophoresis electrodes $EP_1EP_8$ corresponding to groups #1–#8 are provided at the rear internal wall of the sub-chambers, respectively. The electrophoresis electrodes $EP_1$–$EP_8$ are connected to the power source 201 (not shown in this figure) through electrophoresis electrode driver switches $P_1$–$P_8$, respectively. The respective driver switches $P_1$–$P_8$ receive adjusted control signals A'–H' from a pulse width adjuster 206 which receives the control signals A–H from the electrophoresis electrode controller 202. The pulse width adjuster 206 generates the adjusted control signals A'–H' each having a pulse width which is adjusted so as to cancel the effect due to the variations in position and shape of the gate electrode plate 110 or the ejection electrodes 101.

More specifically, the respective adjusted control signals A'–H' have pulse widths T1–T8 corresponding to the electrophoresis electrodes $EP_1$–$EP_8$ so that the respective driver switches $P_1$–$P_8$ switch on and off depending on the pulse widths. The power source 201 generates the electrophoresis electrode driving voltage $V_D$ which is supplied to the driver switches $P_1$–$P_8$. Therefore, depending on the adjusted control signals A'–H', the driving voltage $V_D$ is selectively applied to the electrophoresis electrodes $EP_1$–$EP_8$. As described before, in the case of the driving voltage $V_D$ applied to a selected electrophoresis electrode, the particulate matter 112 is moved toward the ejection electrodes corresponding to the selected electrophoresis electrode due to the electrophoresis phenomenon. Therefore, the longer the pulse width of an adjusted control signal, the more the amount of particulate matter is ejected when the driving voltage $V_{EE}$ is applied to the selected ejection electrodes.

The ejection electrodes 101 number eight hundreds, #1–#800, where eight groups of a hundred ejection electrodes correspond to the groups #1–#8, respectively. For example, the first eight ejection electrodes #1–#100 form a first group corresponding to the group #1, the second eight ejection electrodes #101–#200 form a second group corresponding to the group #2, and so on.

Further, the ejection electrodes 101 are electrically divided into a hundred ejection electrode groups such that the one-hundred ejection electrodes for each group #1, #2, . . . , or #8 are connected to driving lines $L_1$–$L_{100}$, respectively. More specifically, the first ejection electrode for each group is connected in common to a driving line $L_1$. That is, the ejection electrodes #1, #101, #201, . . . #701 are connected in common to the driving line $L_1$. The second ejection electrode for each gate group is connected in common to a driving line $L_2$. That is, the ejection electrodes #2, #102, #202, . . . #702 are connected in common to the driving line $L_2$. It is the same with the third to the hundredth ejection electrodes for each group.

The driving lines $L_1$–$L_{100}$ are connected to the power source 203 through driver switches $J_1$–$J_{100}$, respectively. The respective driver switches $J_1$–$J_{100}$ receive electrode control signals $D_1$–$D_{100}$ from the ejection electrode controller 204. The driver switches $J_1$–$J_{100}$ switch on and off depending on the ejection electrode control signals $D_1$–$D_{100}$, respectively. The power source 203 generates the driving voltage $V_{EE}$ which is supplied to the driver switches $J_1$–$J_{100}$. Therefore, depending on the ejection electrode control signals $D_1$–$D_{100}$, the driving voltage $V_{EE}$ is selectively applied to the driving lines $L_1$–$L_{100}$.

The electrophoresis electrode controller 202 and the ejection electrode controller 204 are controlled by the processor 205 (not shown in this figure) as described before. The details of the control will be described hereinafter.

Figure 5:
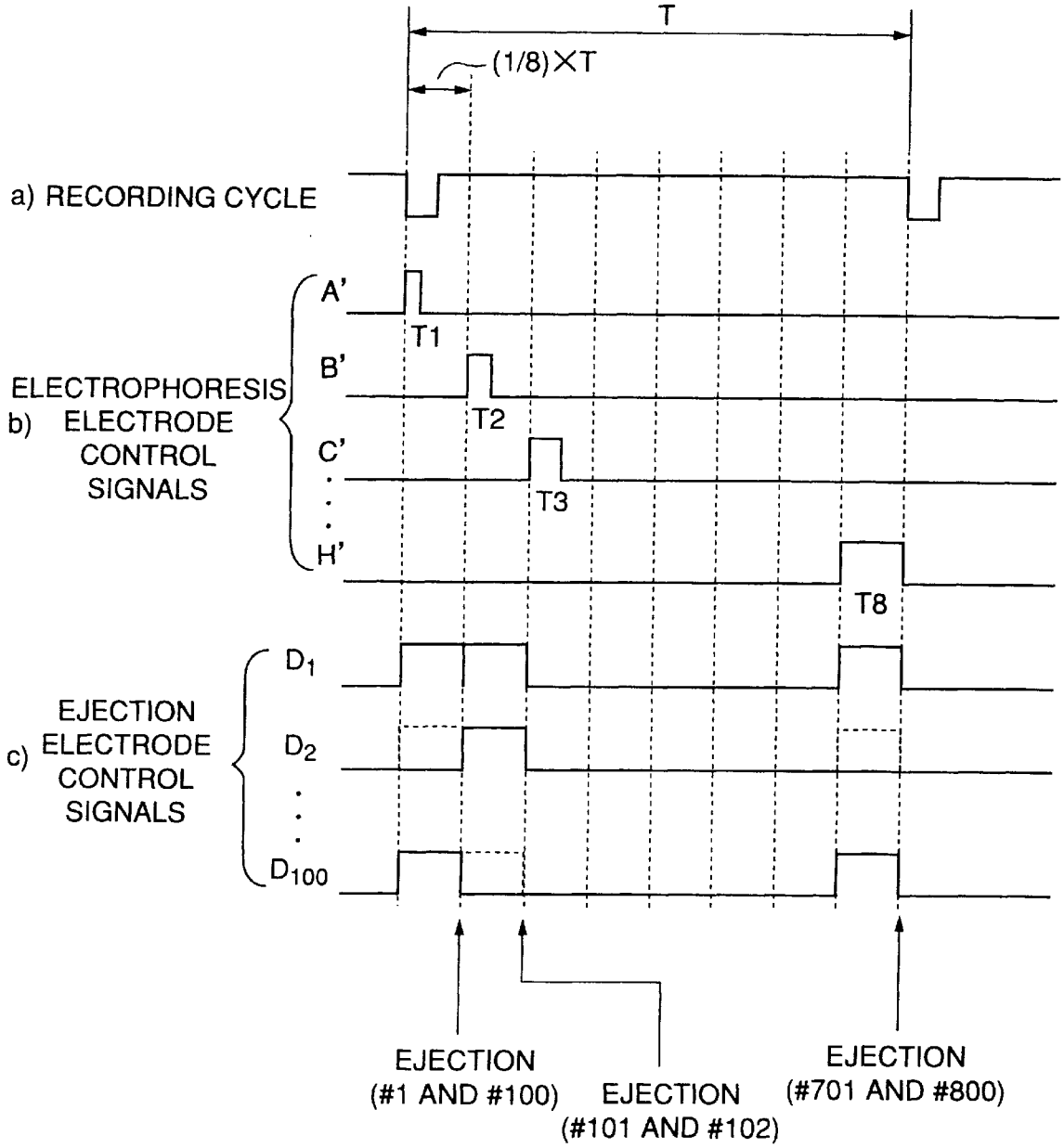
FIG. 5 is a time chart showing control signals for ejection electrodes and electrophoresis electrodes of the inkjet recording apparatus according to the second embodiment.

Referring to FIG. 5, the electrophoresis electrode controller 202 sequentially outputs the control signals A–H to the pulse width adjuster 206 which in turn outputs the control signals A'–H' to the driver switches $P_1$–$P_8$, respectively, during a recording period T. The pulse width of each control signal generated by the electrophoresis electrode controller 202 is set to a time slot obtained by dividing the recording period T by the number of the electrophoresis electrodes $EP_1$–$EP_8$. In other words, the recording period T is time-divided into eight time slots each having a time period of T/8. The pulse width adjuster 206 generates the adjusted control signals A'–H' which correspond to the control signals A–H, respectively, with each adjusted control signal changing in pulse width within a time slot of T/8.

More specifically, as shown in b) of FIG. 5, the respective pulse widths of the adjusted control signals A'–H' are set to time periods T1–T8 which become longer in the order presented, that is, $T1<T2<T3<T4<T5<T6<T7<T8<T/8$. As described before, the pulse width of each adjusted control signal is adjusted so as to provide a uniform amount of ejected ink. Therefore, the pulse widths may be changed depending on variations in the positions and shapes of the gate electrode plate 110 and the ejection electrodes 101.

In parallel with the electrophoresis ejection electrode controller 202, the ejection electrode controller 204 selectively outputs the ejection electrode control signals $D_1$–$D_{100}$ to the driver switches $J_1$–$J_{100}$, respectively, under the control of the processor 205. In this embodiment, the pulse width of each ejection electrode control signal is set to less than the time slot of T/8.

More specifically, when receiving a recording timing pulse from the processor 205, the electrophoresis electrode controller 202 generates the electrophoresis electrode control signals A–H in sequence by which the pulse width adjuster 206 generates the adjusted control signals A'–H' as shown in b) of FIG. 5. For example, when the adjusted control signal A' having a pulse width of T1 rises on the falling edge of the recording timing pulse, the driver switch $P_1$ is closed during the time period T1 to apply the voltage $V_D$ to the electrophoresis electrodes $EP_1$. When the adjusted control signal B' rises after the adjusted control signal A' has fallen, the voltage $V_D$ is applied to the electrophoresis electrode $EP_2$. It is the same with other adjusted control signals C'–H'.

When the ejection control signals $D_1$ and $D_{100}$ rise on the falling edge of the recording timing pulse, the driver switches $J_1$ and $J_{100}$ are closed to apply the driving voltage $V_{EE}$ to the first ejection electrode group of the ejection electrodes #1, #101, #201, . . . , and #701 and the $100^{th}$ electrode group of the ejection electrodes #100, #200, . . . , and #800. Since the electrophoresis voltage $V_D$ is applied only to the first electrophoresis electrode $EP_1$ during the time period T1, the ink with the adjusted amount of particulate matter is ejected only from the ejection electrodes #1 and #100 on the falling edge of the electrode control signals $D_1$ and $D_{100}$.

Subsequently, when the adjusted control signal B' rises in the second time slot, the driver switch $P_2$ is closed during the time period T2 to apply the voltage $V_D$ to the electrophoresis electrode $EP_2$. In the same time slot, when the control signals $D_1$ and $D_2$ rise, the driver switches $J_1$ and $J_2$ are closed to apply the driving voltage $V_{EE}$ to the first ejection electrode group of the ejection electrodes #1, #101, #201, . . . , and #701 and the second electrode group of the ejection electrodes #2, #102, . . . , and #702. Since the electrophoresis voltage $V_D$ is applied only to the second electrophoresis electrode $EP_2$ during the time period T2, the ink with the adjusted amount of particulate matter is ejected only from the ejection electrodes #101 and #102 on the falling edge of the electrode control signals $D_1$ and $D_2$. Similarly, when the adjusted control signal H' and the ejection control signal $D_1$ and $D_{100}$ rise in the last time slot, only the ejection electrodes #701 and #800 eject the ink with the adjusted amount of particulate matter.

As described above, only a total of one hundred and eight driver circuits including a hundred driver switches $J_1$–$J_{100}$ and eight driver switches $P_1$–$P_8$ can drive the eight hundreds ejection electrodes #1–#800.

THIRD EMBODIMENT

Figure 6:
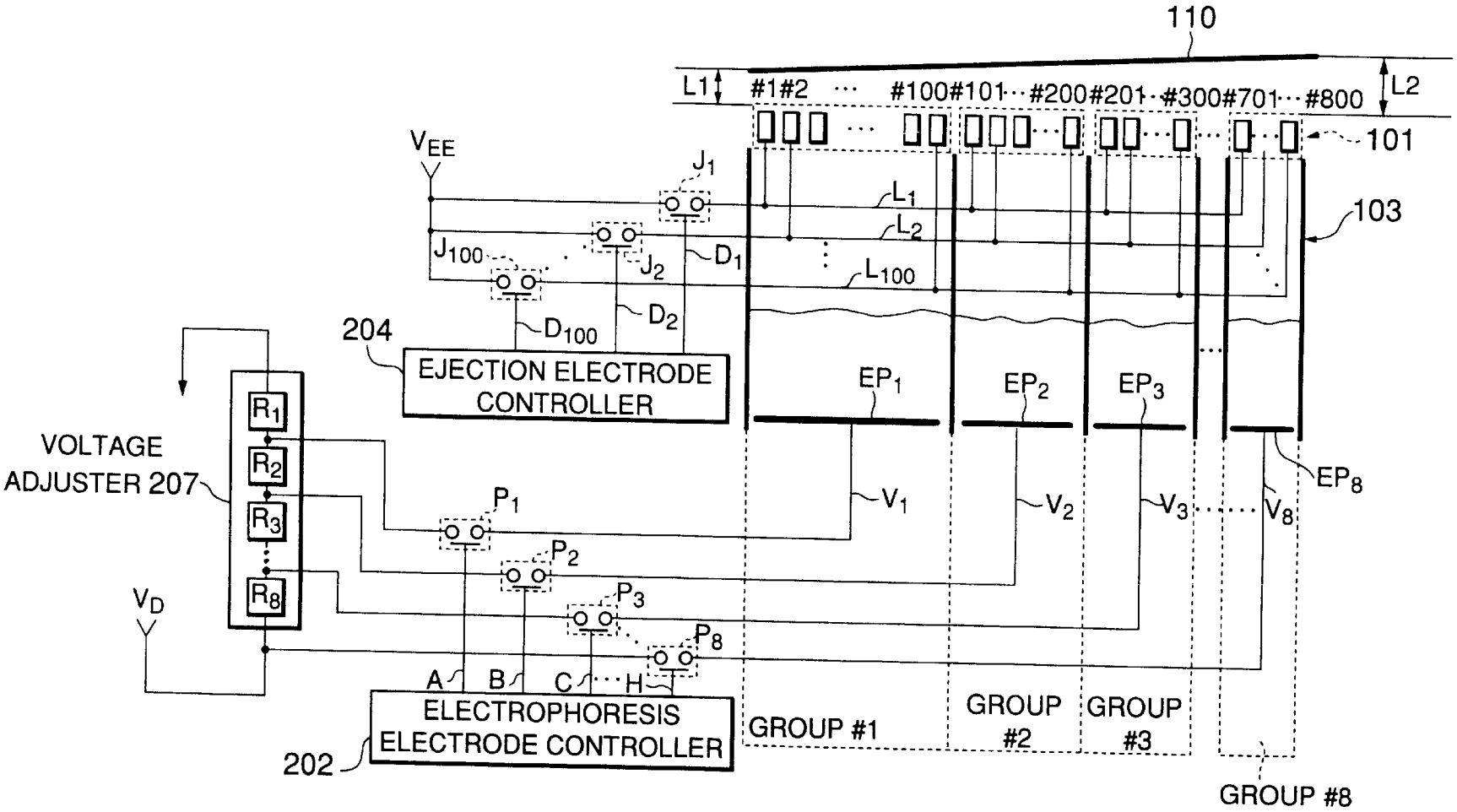
FIG. 6 is a block diagram showing a circuit configuration of the inkjet recording apparatus according to a third embodiment of the present invention.

FIG. 6 shows a circuit of a third embodiment according to the present invention, where elements of the inkjet device similar to those previously described with reference to FIG. 4 are denoted by the same reference numerals and their details are omitted. As in the case of the second embodiment, it is also assumed that the gate electrode plate 110 is not parallel with the array of the ejection electrodes 101 due to variations in the position or shape of the gate electrode plate 110 or the array of the ejection electrodes 101. In the third embodiment, variations in amount of ejected ink can be substantially eliminated by adjusting a voltage applied to each electrophoresis electrode as will be described later.

Referring to FIG. 6, there is provided a voltage adjuster 207 connecting the power source 201 (not shown in this figure) and the driver switches $P_1$–$P_8$. The voltage adjuster 207 is composed of a voltage divider having resistors $R_1$–$R_8$ connected in series to divide the driving voltage $V_D$ into eight gate driving voltages V1–V8. In this embodiment, the driving voltages V1–V8 become higher in the order presented, that is, $V1<V2<V3<V4<V5<V6<V7<V8=V_D$. Therefore, the uneven electrophoresis driving voltages like these can reduce the effect due to variations in positions and shapes of the gate electrode plate 110 and the ejection electrodes 101, resulting in substantially uniform amount of ejected ink. A distribution of the driving voltages V1–V8 may be changed depending on variations in the positions and shapes of the gate electrode plate 110 and the ejection electrodes 101. The driver switches $P_1$–$P_8$ switch on and off depending on the control signals A–H received from the electrophoresis electrode controller 202 and apply the adjusted driving voltages V1–V8 to the electrophoresis electrodes $EP_1$–$EP_8$, respectively.

The present invention is not limited to the combination of the eight driver switches $P_1$–$P_8$ and the one-hundred driver switches $J_1$–$J_{100}$ as shown in FIGS. 4 and 6. Another combination may be possible as in the case of FIG. 2. However, in the second and third embodiments, the pulse width adjuster 206 and the voltage adjuster 207 are needed, respectively. Therefore, it may be preferable that the number of driver switches in the side of the pulse width adjuster 206 or the voltage adjuster 207 is smaller than that of driver switches in the other side.

Further, the present invention is not limited to the driving control sequences as shown in FIGS. 2 and 5. Although the control sequences as shown in FIGS. 2 and 5 are preferable, it is also possible that the ejection electrode control signals are sequentially output and the electrophoresis electrode control signals are selectively output.

Furthermore, the present invention can be applied to the case of variations in the positions of the counter electrode 108.

While the invention has been described with reference to specific embodiments thereof, it will be appreciated by those skilled in the art that numerous variations, modifications, and any combination of the first and second embodiments are possible, and accordingly, all such variations, modifications, and combinations are to be regarded as being within the scope of the invention.

What is claimed is:

1. An apparatus comprising:

a first number K (K is an integer) of first electrodes each for ejecting an aggregation of particulate matter in a predetermined direction;

an second electrode located at a distance from the first electrodes in the predetermined direction;

a second number M (M is an integer smaller than K) of electrophoresis electrodes located at a distance from the ejection electrodes in an opposite direction to the predetermined direction;

a first driving controller for driving a selected one of N groups into which the K ejection electrodes are divided; and a second driving controller for driving a selected one of the M electrophoresis electrodes, wherein ejection of a desired first electrode is caused by driving a selected one of the N groups and a selected one of the M electrophoresis electrodes in a state that a predetermined voltage is applied to the second electrode.

2. The apparatus according to claim 1, wherein the first driving controller sequentially selects one by one from the N groups in a predetermined period divided into N time slots and drives a selected one in a time slot; and the second driving controller drives at least one selected one of the M electrophoresis electrodes in the time slot to cause the ejection of at least one first electrode.

3. The apparatus according to claim 1, wherein the second driving controller sequentially selects one by one from the M electrophoresis electrodes in a predetermined period divided into N time slots and drives a selected one in a time slot; and the first driving controller drives at least one selected one of the N groups in the time slot to cause the ejection of at least one first electrode.

4. The apparatus according to claim 1, wherein M and N are determined as two integral numbers which are closest to the square root of K.

5. The apparatus according to claim 1, wherein the second electrode is a gate electrode plate having K gate electrodes corresponding to the K first electrodes, respectively, wherein each first electrode ejects an aggregation of particulate matter through a gate electrode corresponding to the first electrode.

6. The apparatus according to claim 1, wherein the second electrode is a counter electrode, wherein each first electrode ejects an aggregation of particulate matter toward the counter electrode.

7. An apparatus comprising:

a first number K (K is an integer) of first electrodes each for ejecting an aggregation of particulate matter in a predetermined direction, the K first electrodes being divided into M (M is an integer) blocks each having N first electrodes, where N is K/M;

an second electrode located at a distance from the first electrodes in the predetermined direction;

M electrophoresis electrodes located at a distance from the K first electrodes in an opposite direction to the predetermined direction, each of the M electrophoresis electrodes corresponding to the M blocks of the first electrodes;

a first driving controller for producing a first voltage pulse to be applied to a selected one of N groups into which the K first electrodes are divided in a different way from the M blocks;

a second driving controller for producing a second voltage pulse to be applied to a selected one of the M electrophoresis electrodes; and a controller for controlling the first and second driving controller to drive a selected group and a selected electrophoresis electrode depending on an input signal to cause ejection of a first electrode specified by the selected group and the selected electrophoresis electrode.

8. The apparatus according to claim 7, wherein each of the N groups is formed by electrically connecting an $i^{th}$ ($1 \leqq i \leqq N$) first electrode for each block to each other.

9. The apparatus according to claim 7, wherein the second driving controller comprises:

an adjuster for adjusting the second voltage pulse depending on which one is selected from the M electrophoresis electrode so as to provide a substantially uniform amount of ejected particulate matter and applying an adjusted second voltage pulse to the selected one of M electrophoresis electrodes.

10. The apparatus according to claim 9, wherein the adjuster is a pulse width adjuster for adjusting a pulse width of the second voltage pulse.

11. The apparatus according to claim 9, wherein the adjuster is a voltage adjuster for adjusting a voltage of the second voltage pulse.

12. The apparatus according to claim 9, wherein the second electrode is a gate electrode plate having K gate electrodes corresponding to the K first electrodes, respectively, wherein each first electrode ejects an aggregation of particulate matter through a gate electrode corresponding to the first electrode.

13. The apparatus according to claim 9, wherein the second electrode is a counter electrode, wherein each first electrode ejects an aggregation of particulate matter toward the counter electrode.

14. The apparatus according to claim 9, wherein the first driving controller sequentially selects one by one from the N groups in a predetermined period divided into N time slots and applies the first voltage pulse to a selected one in a time slot; and the second driving controller applies the second voltage pulse to at least one selected one of the M electrophoresis electrodes in the time slot to cause the ejection of at least one first electrode.

15. The apparatus according to claim 9, wherein the second driving controller sequentially selects one by one from the M electrophoresis electrode in a predetermined period divided into N time slots and applies the second voltage pulse to a selected one in a time slot; and the first driving controller applies the first voltage pulse to at least one selected one of the N groups in the time slot to cause the ejection of at least one first electrode.

16. The apparatus according to claim 9, wherein M and N are determined as two integral numbers which are closest to the square root of K.

17. An electrostatic inkjet recording apparatus comprising:

a first number K (K is an integer) of ejection electrodes each for ejecting an aggregation of particulate matter in a predetermined direction, wherein the K ejection electrodes are divided into M (M is an integer) blocks each having N gate electrodes electrically connected in common, where N is K/M;

K gate electrodes located at a distance from the K ejection electrodes in the predetermined direction, the K gate electrodes corresponding to the K ejection electrodes, respectively, so that an aggregation of particulate matter ejected from a selected ejection electrode passes through a gate electrode corresponding to the selected ejection electrode;

a counter electrode located at a distance from the K gate electrodes in the predetermined direction;

M electrophoresis electrodes located at a distance from the K ejection electrodes in an opposite direction to the predetermined direction, each of the M electrophoresis electrodes corresponding to the M blocks of the ejection electrodes;

a first driving controller for applying a first voltage pulse to a selected one of N groups each formed by electrically connecting an $i^{th}$ ($1 \leqq i \leqq N$) ejection electrode for each block to each other;

a second driving controller for applying a second voltage pulse to a selected one of the M electrophoresis electrodes; and a processor for controlling the first and second driving controller to drive a selected group and a selected electrophoresis electrode depending on an input signal to cause ejection of a first electrode specified by the selected group and the selected electrophoresis electrode.

18. The electrostatic inkjet recording apparatus according to claim 17, wherein the first driving controller sequentially selects one by one from the N groups in a predetermined period divided into N time slots and applies the first voltage pulse to a selected one in a time slot; and the second driving controller applies the second voltage pulse to at least one selected one of the M electrophoresis electrodes in the time slot to cause the ejection of at least one ejection electrode.

19. The electrostatic inkjet recording apparatus according to claim 17, wherein the second driving controller sequentially selects one by one from the M electrophoresis electrodes in a predetermined period divided into N time slots and applies the second voltage pulse to a selected one in a time slot; and the first driving controller applies the first voltage pulse to at least one selected one of the N groups in the time slot to cause the ejection of at least one ejection electrode.

20. The electrostatic inkjet recording apparatus according to claim 17, wherein M and N are determined as two integral numbers which are closest to the square root of K.

21. The electrostatic inkjet recording apparatus according to claim 17, wherein the second driving controller comprises:

an adjuster for adjusting the second voltage pulse depending on which one is selected from the M electrophoresis electrodes so as to provide a substantially uniform amount of ejected particulate matter and applying an adjusted second voltage pulse to the selected one of the M electrophoresis electrodes.

22. The electrostatic inkjet recording apparatus according to claim 21, wherein the adjuster is a pulse width adjuster for adjusting a pulse width of the second voltage pulse.

23. The electrostatic inkjet recording apparatus according to claim 21, wherein the adjuster is a voltage adjuster for adjusting a voltage of the second voltage pulse.

24. A control method for an inkjet recording apparatus including K first electrodes each for ejecting an aggregation of particulate matter, a second electrode plate located at a distance from the K first electrodes in an ejection direction, and M electrophoresis electrodes located at a distance from the K first electrodes in an opposite direction to the ejection direction, where K and M are an integer, the control method comprising the steps of:

a) selecting one of N groups formed by dividing the K first electrodes in a first way;

b) selecting one of M electrophoresis electrodes each corresponding to N first electrodes formed by dividing the K first electrodes in a second way different from the first way; and c) driving a selected one of the N groups and a selected one of the M electrophoresis electrodes to eject an aggregation of particulate matter from a first electrode specified by the selected one of the N groups and the selected one of the M electrophoresis electrodes.

25. The control method according to claim 24, wherein the step a) comprises the step of sequentially selecting one by one from the N groups in a predetermined period divided into N time slots; and the step b) comprises the step of driving at least one selected one of the M electrophoresis electrodes in the time slot.

26. The control method according to claim 24, wherein the step b) comprises the step of sequentially selecting one by one from the M electrophoresis electrodes in a predetermined period divided into N time slots; and the step a) comprises the step of driving at least one selected one of the N groups in the time slot.

27. The control method according to claim 24, wherein the step c) comprises the step of:

producing a driving pulse to be applied to the selected one of the M electrophoresis electrodes;

adjusting the driving pulse depending on which one is selected from the M electrophoresis electrodes so as to provide a substantially uniform amount of ejected particulate matter; and applying an adjusted driving pulse to the selected one of the M electrophoresis electrodes.

28. The control method according to claim 27, wherein a pulse width of the driving pulse is adjusted.

29. The control method according to claim 27, wherein a voltage of the driving pulse is adjusted.

30. The apparatus according to claim 9, wherein the adjuster adjusts a pulse width and a voltage of the second voltage pulse.

31. The control method according to claim 27, wherein a pulse width and a voltage of the driving pulse are adjusted.

32. The control method according to claim 24, wherein in the step a), each of the N groups is formed by electrically connecting an $i^{th}$ ($1 \leqq i \leqq N$) first electrode for each block to each other.

* * * * *